US006364183B1

(12) United States Patent
Barnard

(10) Patent No.: US 6,364,183 B1
(45) Date of Patent: Apr. 2, 2002

(54) FOREARM SUPPORTED FLEXIBLE MAIL CARRYING DEVICE

(76) Inventor: Tamela R. Barnard, P. O. Box 636, Independence, KS (US) 67301-0636

( * ) Notice: Subject to any disclaimer, the term of this patent is extended or adjusted under 35 U.S.C. 154(b) by 0 days.

(21) Appl. No.: 09/664,039

(22) Filed: Sep. 18, 2000

(51) Int. Cl.[7] ..... A45F 5/00
(52) U.S. Cl. ..... 224/270; 206/557; 108/43
(58) Field of Search ..... 224/219, 222, 224/267, 250, 270; 108/43; 206/557

(56) References Cited

U.S. PATENT DOCUMENTS 2,284,501 A * 5/1942 Welch
2,690,023 A * 9/1954 Jackson, Jr.
2,881,009 A * 4/1959 Delaney
3,828,696 A * 8/1974 Lockridge
4,243,249 A * 1/1981 Goss
5,323,910 A * 6/1994 Van De Graaf, Jr.

* cited by examiner

*Primary Examiner*—Gregory M. Vidovich

(57) ABSTRACT

A flexible mail carrying device, designed to be carried on the inner forearm between the elbow and hand, which will accommodate a mixed bundle of letter sized and magazine sized mail, as required by the U.S. Postal Service's one-bundle delivery method. The mail carrier includes a firm flexible base unit defining a rectangular back portion, with curved flaps at the full left side and full bottom side, and a movable, rigid, transparent retaining strap for securing the mail bundle. An absorbent washable cover attaches to the outer side of the carrier and can be removed for laundering as desired. The carrier can be used to safely and securely carry mixed bundles of mail, protects the mail pieces from undue body contact and offers a comfortable and hygienic means for a mail carrier to deliver a one-bundle system.

1 Claim, 5 Drawing Sheets

FOREARM SUPPORTED FLEXIBLE MAIL CARRYING DEVICE

CROSS-REFERENCE TO RELATED APPLICATIONS

Not applicable.

BACKGROUND

1. Field of Invention

This invention relates to accessories or support structures, more particularly to arm support structures for use by mail carriers in the delivery of mail.

2. Description of Prior Art

The United States Postal Service (or U.S.P.S.) recently issued an order that mail carriers nation-wide will utilize the "one-bundle" method of delivery. This method requires that letter-sized mail and magazine (or flat)-sized mail be carried together in one bundle. This bundle is to be held on the inner forearm between the elbow and hand, with a second bundle, of letters only, carried in the same hand.

Mail carried loose on the arm in this manner is very unstable, posing the hazard of dropping and/or losing mail. In addition, mail carried thus is in direct contact with the mail person's arm, often causing perspiration to dampen the mail-piece, and ink to bleed onto the arm. Thus a need exists for a mail carrying device specifically designed to safely and hygienically carry a mixed bundle of mail. In the delivery of mail it is standard practice for mail carriers to use large satchel type bags to carry numerous bundles of mail. The present invention works in conjunction with the standard bag already in use.

Various other devices have been proposed to assist a person in the carrying of mail. Some examples are as follows:

(a) U.S. Pat. No. 5,586,700 issued on Dec. 24, 1996 to Fitzner and McCoy shows separate devices for carrying mail according to size categories.

(b) U.S. Pat. No. 5,810,220 issued on Sep. 22, 1998 to Peterson shows a rigid tray plate attached to a forearm strap as an aid for the sorting and delivery of articles of mail.

(c) U.S. Pat. No. 5,836,488 issued on Nov. 17, 1998 to Priestly shows a divided bag structure used to carry, organize and separate different types of mail.

(d) U.S. Pat. No. 5,845,826 issued on Dec. 8, 1998 to Nguyen shows an arm pouch accessory used in the carrying, sorting and delivery of incoming and outgoing mail.

All of the mail carrying devices heretofore known suffer from one or more of the following disadvantages:

(a) they do not address the one-bundle method of delivery now required by the U.S.P.S.

(b) they do not accommodate odd-sized or large flat pieces of mail;

(c) they are not consistent with conventional delivery practice;

(d) they are not flexible enough to accommodate dissimilar mail volume;

(e) they have rigid backing which will not conform to the user's arm or torso and (f) they do not address the sanitary issue of perspiration buildup at body contact points.

SUMMARY OF THE INVENTION

In accordance with the present invention a mail carrying device comprises a firm, flexible back having extended, pliant curving flaps on the left and bottom sides, a movable, transparent retaining strap to secure the mail, and an absorbent washable cover.

Objects and Advantages

Several objects and advantages of the present invention are:

(a) to carry a mixture of letter- and flat-sized mail together in one bundle;

(b) to keep the mail secure and prevent it from falling under the arm or from the bottom of the bundle;

(c) to eliminate direct contact between the mail and the mail person's arm;

(d) to provide an absorbent cover that can be removed and laundered as needed;

(e) is flexible and lightweight and will conform to the user's arm and torso;

(f) will not interfere with body movements;

(g ) accommodates large or odd-sized mail pieces and (h) is consistent and compatible with the conventional delivery practice.

Further objects and advantages are that the device is fully adaptable to various sized bundles. The extended flaps are independent of each other and will accommodate a large bundle of assorted mail or other objects with ease. An elasticized strap with a transparent insert secures the bundle from the top without obscuring the addresses.

The present invention also addresses the issue of perspiration buildup between the mail bundle and the mail person's arm by providing an absorbent cover. This cover can be removed and laundered as needed. One major complaint of carrying mail in one bundle is that it is awkward and unreasonable to carry. The present invention eliminates the instability of the bundle while additionally protecting the mail from the mail person's perspiration.

The carrying device is safe and easy to use. It is not attached to the body in any way and drops easily into a satchel whether loaded or empty. It can be loaded with ease simply by sliding a bundle of mail under the movable retaining strap. Since the top and right sides are open the mail can be removed from the bundle quickly and in a manner consistent with current delivery practice.

The device is lightweight and comfortable and does not interfere with body movements. The flexible back will conform to an individual user's arm and torso. Its'small size allows it to fit on the inner forearm between the elbow and hand. The padded back and removable/washable cover offer elements of comfort and hygiene not considered in the prior art.

These and other objects, features and advantages of this invention will become apparent from the following detailed description of the various aspects of the invention taken in conjunction with the accompanying drawings.

Drawing Reference Numerals

| | | | |
|---|---|---|---|
| 10 | mail carrying device | 12 | flexible base unit |
| 12a | back portion | 12b | left side flap |
| 12c | bottom flap | 18 | striations for bending |
| 20a, b | slots for retaining strap | 22 | pad |
| 24 | cover | 26 | binding |
| 28 | stitching | 40 | retaining strap |
| 42a, b | elastic straps | 44a, b | first, second fastening devices |
| 46 | transparent bar | 48a, b | holes for elastic strap |
| 60 | removable cover | 62 | moisture permeable fabric |
| 64 | absorbent core | 66 | moisture impermeable fabric |
| 80 | inner forearm | 82 | hand |
| 84 | elbow | 86 | mixed bundle mail |
| 88 | letter mail | 90 | satchel |

DETAILED DESCRIPTION OF THE PREFERRED EMBODIMENTS

Figure 1:
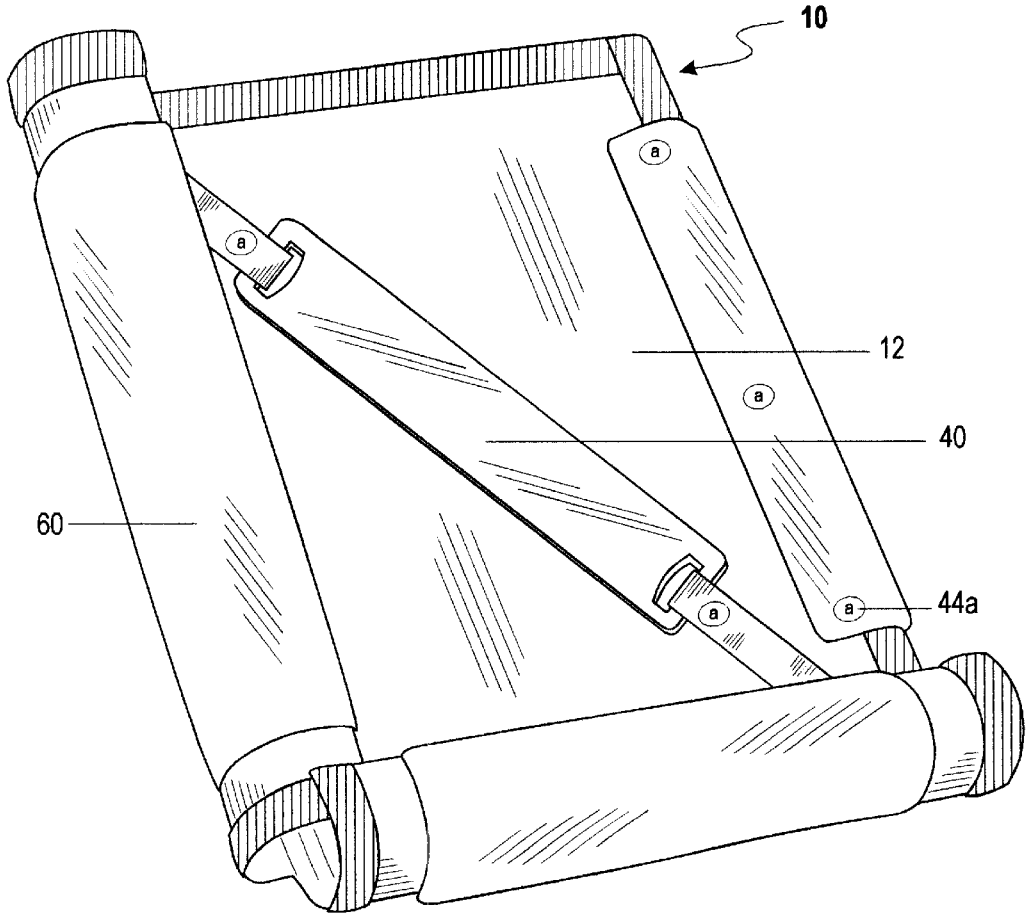
FIG. 1 is an isometric view of a flexible mail carrying device in accordance with the present invention.

A typical embodiment of a flexible mail carrying device 10 is illustrated in FIG. 1. Mail carrying device 10 comprises a flat, flexible base unit 12, a retaining strap 40, and a removable absorbent cover 60. Cover 60 is attached to back portion 12 with first fastening device 44*a*.

It is to be understood that any first and second closure means such as metal snap fasteners or a hook and loop material may be used as a releasable fastening device and would function in an equivalent manner. Fastening devices 44a and b are represented herein by an encircled a or b.

Figure 2:
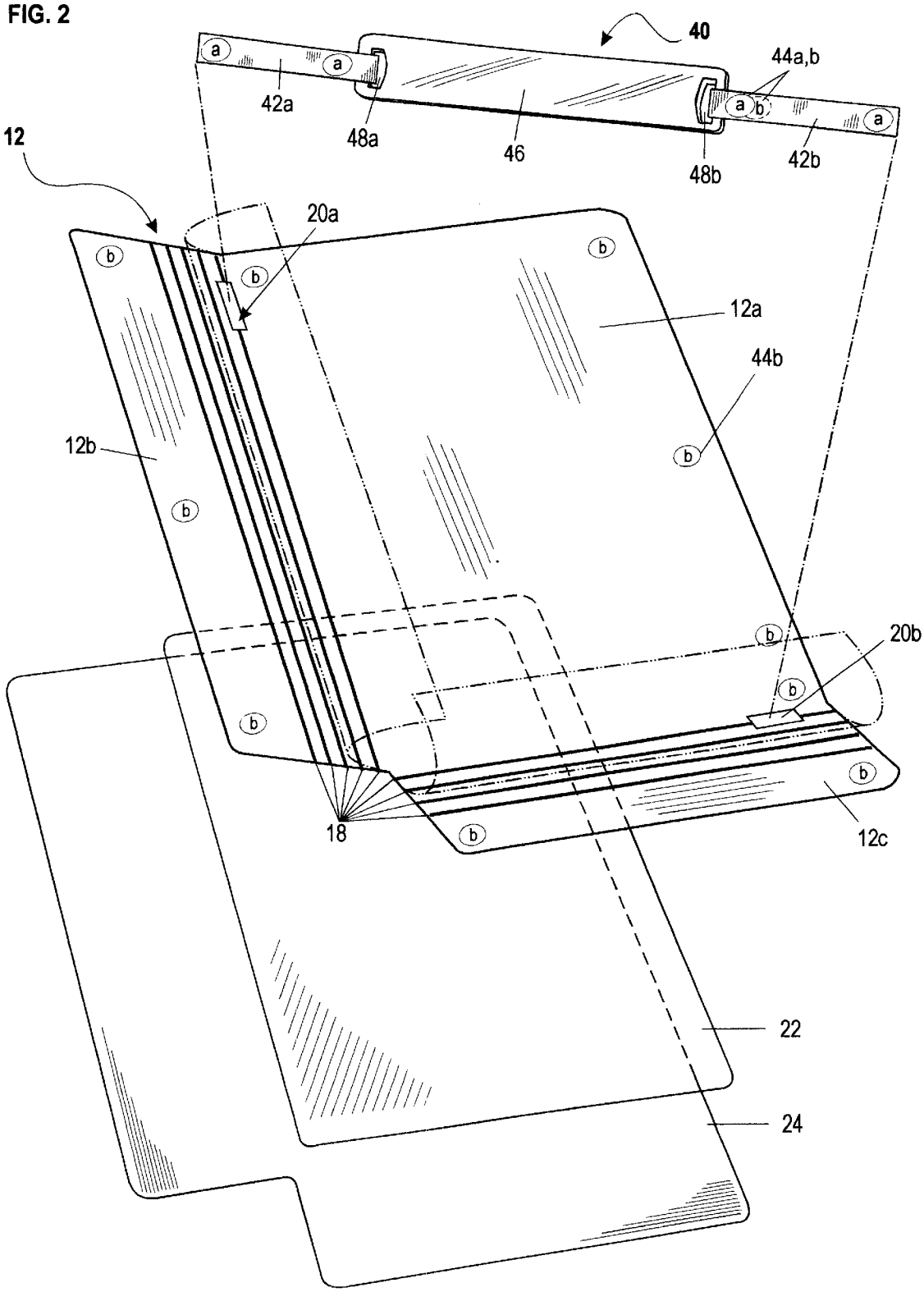
FIG. 2 is an exploded view of the parts of the carrying device of FIG. 1.

Referring to FIG. 2 there is shown an exploded view of the flexible base unit 12 of FIG. 1. Base unit 12 is preferably cut from one piece of leather, providing a firm, flexible foundation for the device. Pattern for the base unit 12 defines a rectangular back portion 12*a*, a left side flap 12*b* and bottom flap 12*c*. Striations 18 are cut into left side flap 12*b* and bottom flap 12*c*, promoting disciplined flexibility which allows flaps to curve upward, creating left side and bottom side protective walls when the carrying device is in use. Second fastening devices 44*b* are attached to provide a means of securing cover 60 to base 12. Two slots, 20*a* and 20*b*, are cut through base 12, with fastening devices 44*b* attached near slots 20*a* and 20*b* for securing strap 40 (see FIG. 3) to reverse side of base unit 12.

Retaining strap 40 comprises a rigid transparent bar 46 secured, at points 48*a* and 48*b* with fastening devices 44*a* and 44*b*, to elastic straps 42*a* and 42*b*.

A foam pad 22 is laminated to the reverse side of back portion 12*a*, leaving left side flap 12*b* and bottom flap 12*c* unpadded. A protective cover 24 is glued over entire reverse side of base unit 12. This cover is preferably made of a moisture impermeable fabric such as treated canvas.

Figure 3:
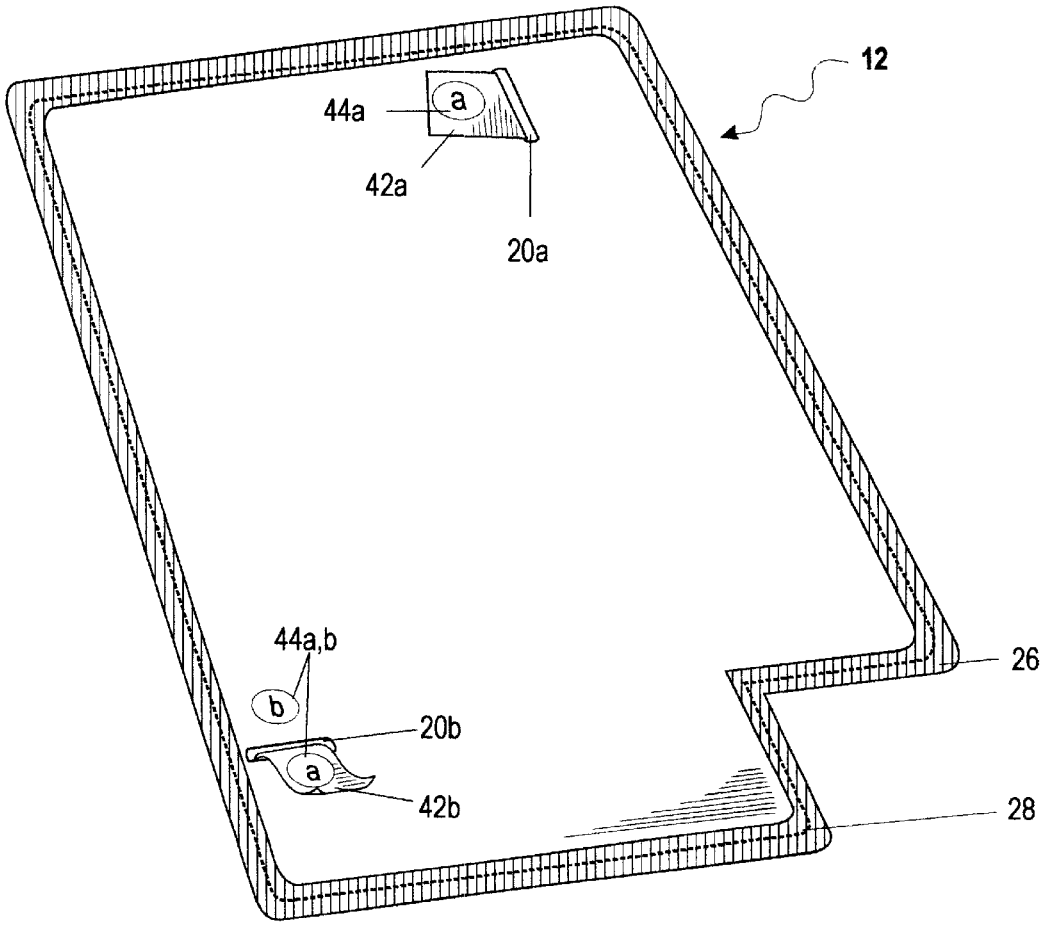
FIG. 3 is the back view of the carrying device of FIG. 1.

FIG. 3 depicts the reverse side of assembled base unit 12. Elastic straps 42*a* and 42*b* are pictured, as they would be when threaded through slots 20*a* and 20*b* in base unit 12, and secured with fasteners 44*a, b*. A fabric or synthetic trim binding 26 is stitched 28 around base 12 to provide a finished edge for the carrying device 10 of FIG. 1.

Figure 4:
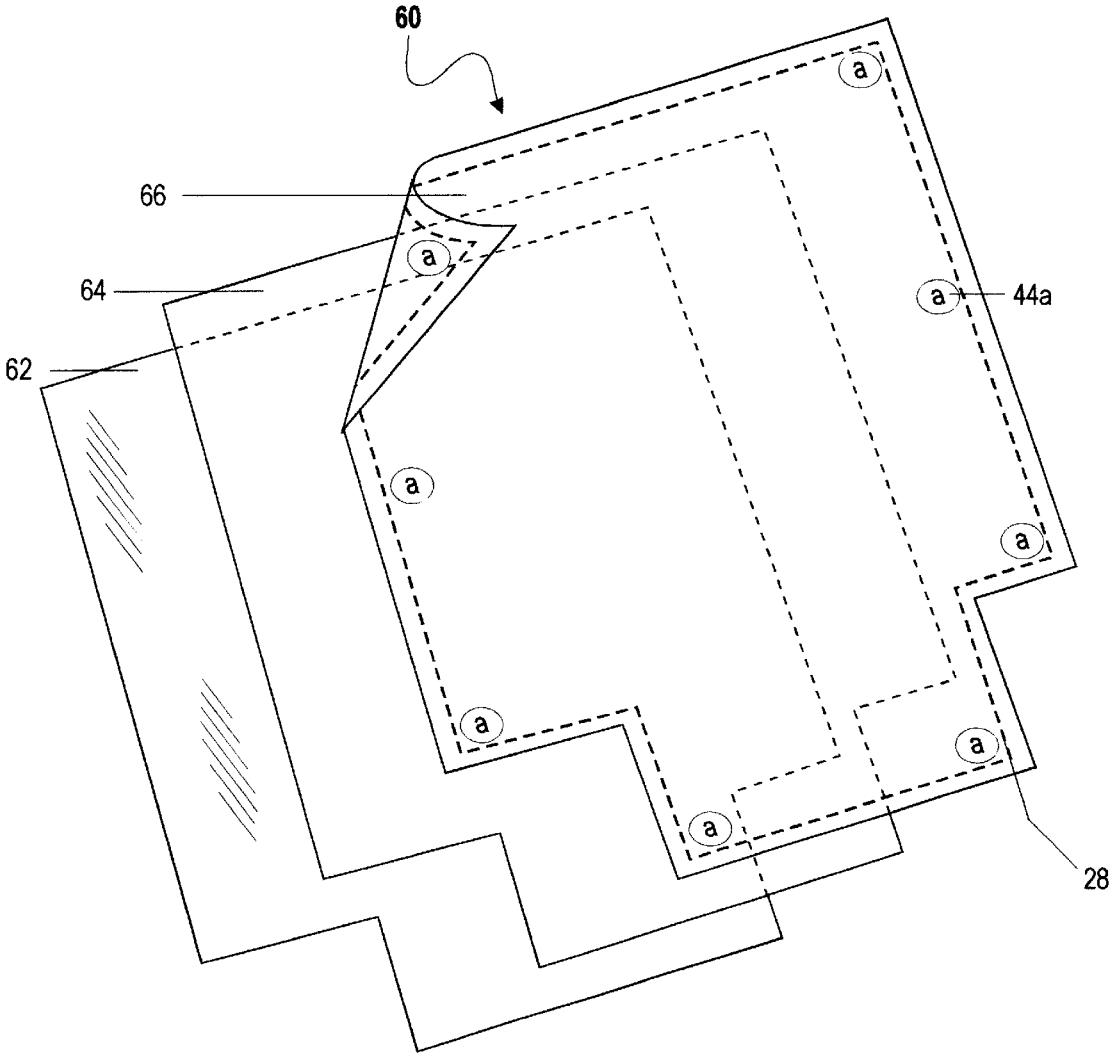
FIG. 4 is a view of the cover device of FIG. 1.

Referring to FIG. 4, there is shown an exploded view of removable cover 60. Cover 60 comprises a first layer of body contacting fabric 62, preferably made of a quick-drying moisture permeable cotton or synthetic. An absorbent core 64 is captured between the fabric 62 and a protective barrier fabric 66. Core 64 is preferably made of a moisture retaining fabric or fiber and is in a moisture-communicative relationship with fabric 62. Perspiration in contact with fabric 62 is transferred to core 64 and retained. Fabric 66 is preferably made of a moisture impermeable material that will prevent moisture entrapped in core 64 from escaping onto base 12. Fabric 62, core 64 and fabric 66 are sewn together with stitching 28 to provide a finished edge for cover 60. Also shown in FIG. 4 are fasteners 44*a*, which secure the cover 60 to base 12.

Figure 5:
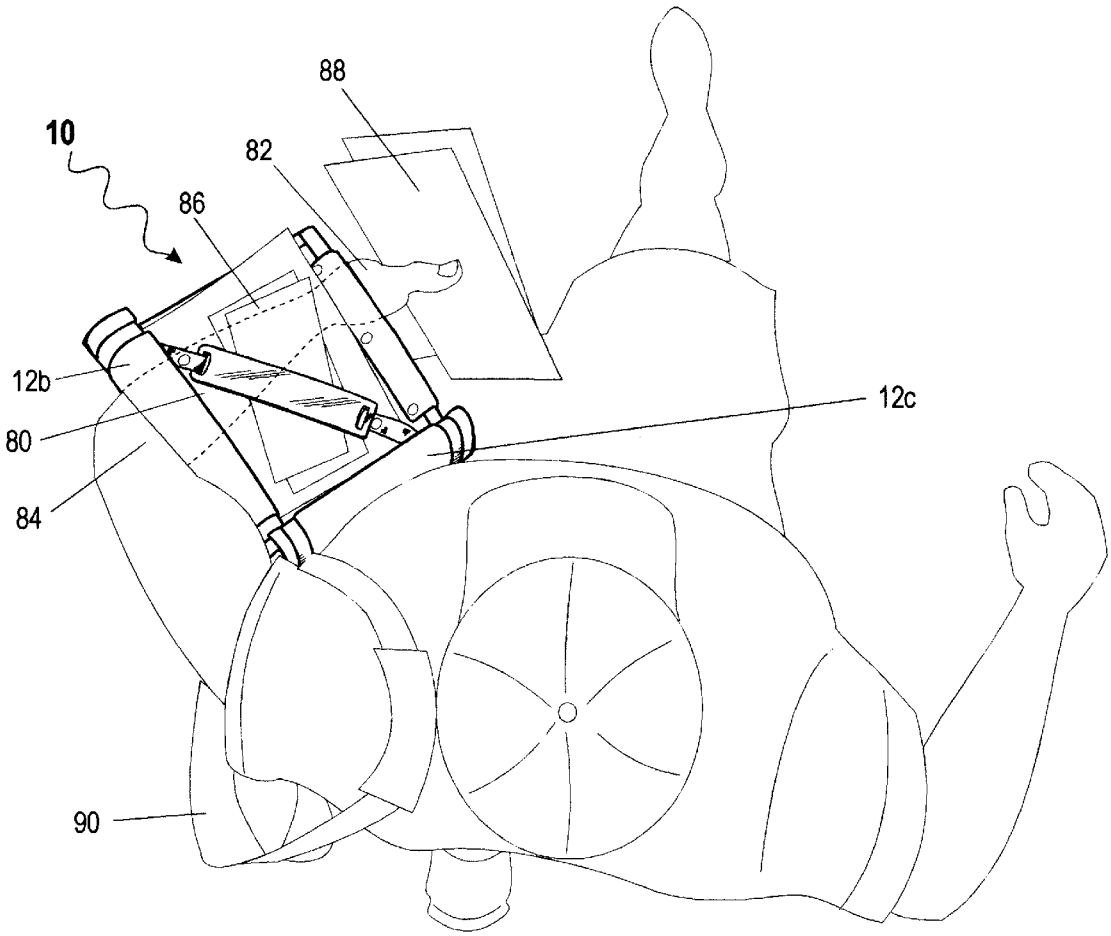
FIG. 5 is a perspective view of the carrying device of FIG. 1, shown as used for ail delivery operations.

FIG. 5 depicts the preferred use of the present invention in typical daily activity of a postal employee with a carrier satchel 90 on one shoulder. Carrying device 10 is placed on a mail person's inner forearm 80 between the hand 82 and elbow 84, with the left side wall 12*b* readily held in place at the elbow, and the bottom wall 12*c* resting against the user's torso. Carrying device 10 is designed to hold and secure a mixed bundle of mail 86 while allowing the user's left hand 82 to be free to hold the requisite bundle of letter mail 88. Thus the user's right hand is free to remove mail from the mixed bundle 86 and letter bundle 88 and collate them for delivery to the customers mail box.

SUMMARY AND SCOPE

Accordingly, the reader will note that the mail carrier support can be used to securely carry a bundle of different sizes of mail on the arm. The user will not be hampered with loose mail or unmanageable bundles. The movable transparent strap securing the mail will not prevent the user from seeing the address on the mail. The carrier support provides a comfortable means of complying with the one-bundle method of delivery prescribed by the United States Postal Service. In addition, the removable absorbent cover allows a mail person the option of laundering away accumulated perspiration at the end of each day, or as desired.

Furthermore, the present invention has additional advantages. The carrier support can be designed in the reverse of the prescribed embodiment, and thus rest on the user's right arm. Alternatively, the carrier could be designed with a square base unit back portion, with two options for placement of the retaining strap, thus allowing the same unit to be used on either arm with only minimal reduction in effectiveness. The base unit can be made of any flexible material; hook and loop fasteners can be used in place of the metal snaps. The retaining strap can be made adjustable to accommodate various articles of transport.

A variety of fabrics and foam can be chosen for the covers and padding. The device can be made padded or unpadded. The carrier support can be any color, or present any type of personal or corporate logo. User can carry U.S. Postal mail, office mail or any other object(s) that can be held between the inner forearm and hand on the average adult human body.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

I claim:

1. A device for carrying mail, the device adapted to be carried on a person's inner forearm between the elbow and the hand, the device including:

a. a flat, flexible base unit which comprises:

i. a rectangular back portion, an extended left side flap, striated to form a curving side wall, and an extended bottom flap, striated to form a curving bottom wall;

ii. a foam pad mounted on the reverse side of said back portion;

iii. a moisture-impermeable fabric layer mounted on top of said foam pad, being of size sufficient to cover entire said base unit, with said foam pad captured therein;

iv. a plurality of fastening devices as a means of attaching a retaining strap and a removably attached absorbent cover to said base unit and v. fabric or synthetic trims sewn around said base unit to provide a finished edge;

b. a movable retaining strap comprising:

i. two sections of an elastic material, of a predetermined length, each section having first and second ends, each said first end having a means of releasable attachment to said fastening devices of said base unit on said reverse side of said base unit, at points perpendicular to, and inside, the top and right edges, respectively, of said back portion;

ii. a rigid transparent member, of a predetermined length, being removably attached to said elastic material sections at said second ends thereof;

c. a washable absorbent cover being of a size sufficient as to be folded about a respective edge of said base unit, with a sewn finished edge, said absorbent cover comprising:

i. a body contacting quick-drying moisture-permeable cover layer;

ii. an absorbent core on top of said body-contacting moisture-permeable cover layer, said absorbent core being in a moisture-communicative relationship with the cover layer, whereby perspiration in contact with said cover layer is transferred to said absorbent core to be retained therein;

iii. a moisture impermeable barrier layer on top of said absorbent core, said barrier layer preventing moisture entrapped in said absorbent core from egressing the barrier layer onto surface of said base unit; and iv. a plurality of releasable fastening devices as a means of attaching said absorbent cover to said fastening devices of said base unit.

* * * * *